US010784617B2

(12) United States Patent
Klimpel et al.

(10) Patent No.: US 10,784,617 B2
(45) Date of Patent: Sep. 22, 2020

(54) PLUG CONNECTOR WITH A CONTACTING PORTION FOR DIVERTING AN ELECTRIC ARC

(71) Applicant: Phoenix Contact GmbH & Co. KG, Blomberg (DE)

(72) Inventors: Marc Klimpel, Lage (DE); Michael Blauth, Paderborn (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 16/310,466

(22) PCT Filed: Jun. 6, 2017

(86) PCT No.: PCT/EP2017/063677
§ 371 (c)(1),
(2) Date: Dec. 17, 2018

(87) PCT Pub. No.: WO2018/001681
PCT Pub. Date: Jan. 4, 2018

(65) Prior Publication Data

US 2019/0334279 A1 Oct. 31, 2019

(30) Foreign Application Priority Data

Jun. 28, 2016 (LU) ..... 93125

(51) Int. Cl.
*H01R 13/53* (2006.01)
*H01R 13/03* (2006.01)
(Continued)

(52) U.S. Cl.
CPC ..... *H01R 13/53* (2013.01); *H01R 13/03* (2013.01); *H01R 13/04* (2013.01); *H01R 13/111* (2013.01)

(58) Field of Classification Search
CPC ..... H01R 13/53; H01R 13/03; H01R 13/04; H01R 13/111; H01R 13/6485; H05K 9/0067; H05K 9/0079; Y10S 439/9241
(Continued)

(56) References Cited

U.S. PATENT DOCUMENTS 5,649,840 A 7/1997 Muto
5,676,571 A 10/1997 Matthews
(Continued)

FOREIGN PATENT DOCUMENTS

CN 201741874 U 2/2011
DE 10351393 A1 5/2004
(Continued)

OTHER PUBLICATIONS

JP 63050469 Translation, Published Apr. 5, 1988, [database online], [retrieved on Apr. 27, 2020] (Year: 1988).*

*Primary Examiner* — Travis S Chambers
(74) *Attorney, Agent, or Firm* — Leydig, Voit & Mayer, Ltd.

(57) ABSTRACT

A plug connector part for electrically contacting a mating plug connector part includes: a contact element, which is engageable in a plug-in manner with a mating contact element of an associated mating plug connector part in an insertion direction for electrical contacting; and a lance element that includes an at least partially resilient shaft and a contacting portion, the shaft being connected to the contact element at a first end and the contacting portion being arranged at a second end of the shaft such that the contacting portion remains in electrical contact with the mating contact element of the mating plug connector part when the connector part is released from the mating plug connector part after the electrical contact between the contact element and the mating contact element has already been broken.

10 Claims, 4 Drawing Sheets

(51) Int. Cl.
*H01R 13/04* (2006.01)
*H01R 13/11* (2006.01)

(58) Field of Classification Search
USPC ..... 439/181, 95, 826, 827, 856, 862, 924.1
See application file for complete search history.

(56) References Cited

U.S. PATENT DOCUMENTS

| | | | | |
|---|---|---|---|---|
| 6,261,134 | B1 * | 7/2001 | Muzslay | H01R 43/16 29/857 |
| 6,382,998 | B2 * | 5/2002 | Miwa | H01R 13/6485 439/181 |
| 6,390,839 | B2 * | 5/2002 | Miwa | H01R 13/6485 439/181 |
| 6,478,593 | B2 * | 11/2002 | Miwa | H01R 13/6485 439/181 |
| 6,762,376 | B2 * | 7/2004 | Nakamura | H01H 9/085 200/51.01 |
| 7,080,999 | B2 * | 7/2006 | Narui | H01R 13/6315 439/246 |
| 2004/0137772 | A1 | 7/2004 | Ota et al. | |
| 2004/0180563 | A1 | 9/2004 | Coughlan et al. | |

FOREIGN PATENT DOCUMENTS

| | | | |
|---|---|---|---|
| DE | 10324903 | B3 | 2/2005 |
| DE | 102011050695 | B3 | 10/2012 |
| EP | 1283565 | A2 | 2/2003 |
| EP | 1284526 | A2 | 2/2003 |
| JP | 6350469 | U | 4/1988 |
| JP | 0922757 | A | 1/1997 |
| JP | 2013161640 | A | 8/2013 |

* cited by examiner

PLUG CONNECTOR WITH A CONTACTING PORTION FOR DIVERTING AN ELECTRIC ARC

CROSS-REFERENCE TO PRIOR APPLICATIONS

This application is a U.S. National Phase application under 35 U.S.C. § 371 of International Application No. PCT/EP2017/063677, filed on Jun. 6, 2017, and claims benefit to Luxembourg Patent Application No. LU 93125, filed on Jun. 28, 2016. The International Application was published in German on Jan. 4, 2018 as WO 2018/001681 under PCT Article 21(2).

FIELD

The invention relates to a plug connector part for electrically contacting a mating plug connector part, and to a method for bringing a plug connector part into electrical contact with a mating plug connector part.

BACKGROUND

A plug connector part of this type comprises a contact element which can be engaged in a plug-in manner with a mating contact element of an associated mating plug connector part in an insertion direction for electrical contacting. When plugged in, the contact element is in electrical contact with the mating contact element such that power can be transmitted between the contact element and the mating contact element.

A plug connector part of this type may for example be used in solar plants or in automotive engineering.

If the connection between a plug connector part and a mating plug connector part is established under load, an arc may be produced between the contact element and the mating contact element when establishing a plug-in connection before the contact element comes into electrical contact with the mating contact element. Likewise, when disconnecting the plug connector part from the mating plug connector part, an arc may be produced when the contact between the contact element and the mating contact element is broken. An arc of this type may cause damage to the contact element and also to the mating contact element and, if switching processes are carried out frequently, may lead to destruction in extreme cases.

For those plug connectors that are also intended to be switched under load (what are known as connectors with breaking capacity, or CBC for short), measures therefore need to be provided to protect against damage from an arc.

In a plug connector known from DE 10 2011 050 695 B3, a pin made of an outgassing material is provided on a plug connector part. If an arc is produced between the contact element of the plug connector part and an associated mating contact element of a mating plug connector part, the outgassing material releases gas which cools the arc or increases the resistance for the arc.

In a plug connector known from DE 103 51 393 A1, portions made from an arc-resistant material are formed on the plug connector parts.

In a plug connector known from DE 103 24 903 B3, insulating regions are formed on the plug connector parts, which regions are intended to prevent an arc from being produced between electrically conductive portions.

SUMMARY

In an embodiment, the present invention provides a plug connector part for electrically contacting a mating plug connector part, comprising: a contact element, which is engageable in a plug-in manner with a mating contact element of an associated mating plug connector part in an insertion direction for electrical contacting; and a lance element that comprises an at least partially resilient shaft and a contacting portion, the shaft being connected to the contact element at a first end and the contacting portion being arranged at a second end of the shaft such that the contacting portion remains in electrical contact with the mating contact element of the mating plug connector part when the connector part is released from the mating plug connector part after the electrical contact between the contact element and the mating contact element has already been broken.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
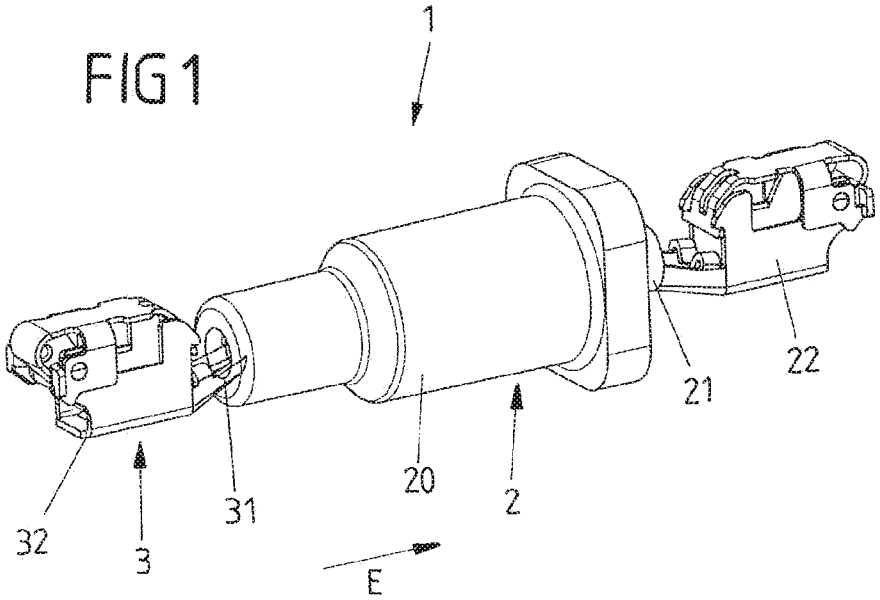
FIG. 1 is a perspective view of a plug connector, comprising a plug connector part intended to be engaged with a mating plug connector part in an insertion direction in a plug-in manner.

In an embodiment, the present invention provides a plug connector part and a method for bringing a plug connector part into contact with a mating plug connector part which allow reliable protection against damage by an arc in a simple, cost-effective manner when switching under load.

Accordingly, the plug connector part comprises a lance element which comprises an at least partially resilient shaft and a contacting portion. The shaft is connected to the contact element at a first end. A contacting portion is arranged at a second end of the shaft such that the contacting portion remains in electrical contact with the mating contact element of the mating plug connector part when the plug connector part is released from the mating plug connector part after the electrical contact between the contact element and the mating contact element has already been broken.

Conversely, the contacting portion is preferably designed to come into electrical contact with the mating contact element of the mating plug connector part before the contact element when the plug connector part is plugged into the mating plug connector part.

An additional element is thus provided on the contact element which comes into contact with the mating contact element before the contact element when the plug connector part is plugged into the associated mating plug connector part. When inserting said plug connector part, an arc may be produced between the mating contact element and the contacting portion of the lance element, but not between the mating contact element of the mating plug connector part and the contact element of the plug connector part.

Conversely, the contacting portion of the lance element remains in contact with the mating contact element after the electrical contact between the contact element and the mating contact element has already been broken when the plug connector part is disconnected from the mating plug connector part. When disconnecting said plug connector part, too, an arc may thus be produced only between the mating contact element and the contacting portion, and not between the mating contact element and the contact element.

Damage to the contact element from an arc can thus be effectively prevented.

The contacting portion is a sacrificial portion which can readily tolerate damage from an arc. The contacting portion does not have an essential function for the actual contacting for the purpose of power transmission.

In order to increase the resistance of the contacting portion, the contacting portion may be made of an arc-resistant material at least in part or may be coated with an arc-resistant material, such that the contacting portion has advantageous resistance to damage from an arc. An arc-resistant material of this type may for example be a silver/nickel material (Ag/Ni), a tungsten/copper material (W/Cu), a silver/zinc oxide material (Ag/SnO2), or a silver/copper material (Ag/Cu). Other materials are conceivable and possible.

The contacting portion contacting the mating contact element of the mating plug connector part before the contact element when being plugged in can for example be achieved by the contacting portion of the lance element projecting beyond the contact element of the plug connector part in the insertion direction. When viewed in the insertion direction, the contacting portion is thus arranged in front of an end of the contact element to be plugged into the mating contact element, such that the contacting portion initially comes into contact with the mating contact element when the plug connector part and the mating plug connector part are engaged with one another in a plug-in manner in the insertion direction.

A projecting configuration of this type is not compulsory, however. It is crucial that the contacting portion first connects the lance element and, during disconnection, constitutes the last electrically conductive contact between the plug connector part and the associated mating plug connector part. This does not necessarily mean that the contacting portion also geometrically protrudes or projects.

Conversely, when disconnecting the plug connector part and the mating plug connector part, the contacting portion remains in contact with the mating contact element over a certain distance when the contact element has already lost contact with the mating contact element.

When plugging in and disconnecting said plug connector part, an arc is thus produced between the mating contact element and the contacting portion of the lance element, but not between the mating contact element and the contact element.

It should be noted here that the contact element may be a contact pin or a contact socket.

The contact element may have a cylindrical or planar shape.

The lance element prevents damage to the contact element by an arc being produced. If an arc originates from a region of the mating contact element that is not critical to the operation of the plug connector (for example from a tip of the mating contact element that is operationally less significant to the contacting), an arc does not have a damaging effect on operationally significant parts of the contact element of the plug connector part and of the mating contact element of the mating plug connector part.

In a first variant, the contacting portion may be formed by a separate contacting element arranged on the shaft. A contacting element of this type may for example be arranged on the head of the shaft and may be fastened to the head in the manner of a rivet. The contacting element may consist completely of an arc-resistant material or may alternatively be coated with an arc-resistant material. In this case, the shaft of the lance element does not have to be made of an arc-resistant material.

In a second variant, it is also conceivable and possible to select the contacting portion to be integral with the shaft of the lance element. The contacting portion is thus directly molded on the shaft, for example on an end portion of the shaft. In this case, the shaft is preferably completely made of an arc-resistant material or coated with an arc-resistant material.

Here, the entirety of the lance element is made of an electrically conductive material, such that the contacting portion can electrically contact the mating contact element.

In one embodiment, the shaft is connected to the contact element at its first end by a connecting collar. The connecting collar surrounds the contact element such that the shaft is interlockingly attached to the contact element.

Other connections are conceivable, however. The lance element may for example be welded to the contact element, pressed into said contact element or interlockingly connected, force-locked or integrally bonded to said contact element in another way.

The shaft preferably extends on the contact element in parallel with the insertion direction. Here, when viewed radially with respect to the insertion direction, the shaft advantageously extends outside the contact element and thus laterally in parallel with the contact element. By the shaft being resilient at least in part (for example made of an inherently resiliently flexible material), the shaft can be deflected radially with respect to the insertion direction when the plug connector part is engaged with the associated mating plug connector part in a plug-in manner. The contacting portion on the shaft thus comes into contact with the mating contact element of the mating plug connector part under resilient pretension, such that electrical contacting is produced between the contacting portion on the contact element side of the plug connector part and the mating contact element on the mating plug connector part side.

It is also conceivable for the shaft not to extend in parallel with the contact element. In stages, the shaft may also be curved or may extend transversely to the contact element in portions.

In a specific embodiment, the contact element may for example be designed as a contact socket. In this case, the contact element comprises a plurality of contact elements, which form an insertion opening therebetween into which the mating contact element in the form of a contact pin of the mating plug connector part can be inserted. Here, the lance element preferably extends outside the insertion opening, in parallel with the contact blades pointing in the insertion direction.

In another embodiment, however, the contact element of the plug connector part may also be designed as a contact pin that can be engaged with a mating contact element in the form of a contact socket of the mating plug connector part in a plug-in manner.

In one embodiment, a plurality of lance elements may also be arranged on the contact element. Lance elements of this type may for example be connected to the contact element such that the lance elements are distributed over the circumference of the contact element. Here, each lance element comprises a contacting portion such that an arc can be diverted via a plurality of lance elements.

In one embodiment, the plug connector part comprises a housing which forms a space in which the contact element is arranged. In this case, the mating contact element of the mating plug connector part may be engaged with a plug opening in the housing in order to establish electrical contact with the contact element of the plug connector part inside the housing.

A plug connector comprises a plug connector part of the above-described type and a mating plug connector part that can be engaged with the plug connector part in a plug-in manner. Here, the plug connector part may comprise a contact element in the form of a socket, a contact pin or even a hermaphroditic contact, while the mating plug connector part comprises an associated, complementary mating contact element. In this case, a lance element may be arranged both on the plug connector part side and on the mating plug connector part side, i.e. for example on the socket side and on the pin side of the contact elements. It is also conceivable to design a plug connector to have two lance elements (one on the plug connector part and one on the mating plug connector part), which come into contact when said connector parts are plugged into one another. If a plug-in connection of this type is disconnected, the contact elements relevant to the electrical operation first lose their conductive connection, while the lance elements remain in contact with one another. If, when detached to a greater extent, the lance elements also lose contact, an arc is only produced between said two lance elements.

In an embodiment, the present invention provides a method for bringing a plug connector part into electrical contact with a mating plug connector part, in which a contact element of the plug connector part is engaged in a plug-in manner with a mating contact element of the mating plug connector part in an insertion direction for electrical contacting. In this case, in a plug-in connection, a contacting portion of a lance element that comprises an at least partially resilient shaft that is connected to the contact element at a first end and supports the contacting portion at a second end comes into electrical contact with the mating contact element of the mating plug connector part before the contact element.

The advantages and advantageous embodiments described above in relation to the plug connector part are similarly also applicable to the method, and therefore reference should be made to that stated above in this regard.

Figure 2A:
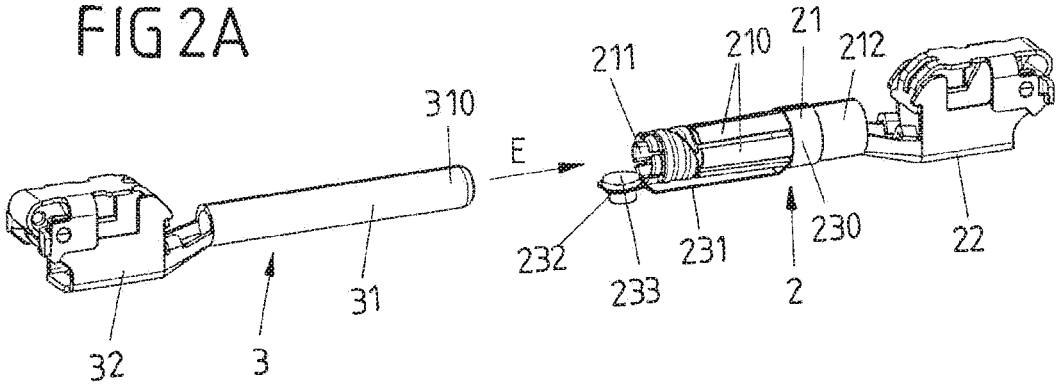
FIG. 2A is a view of the plug connector part and the mating plug connector part before a contact element of the plug connector part has come into electrical contact with a mating contact element of the mating plug connector part, without a housing of the plug connector part.
Figure 2B:
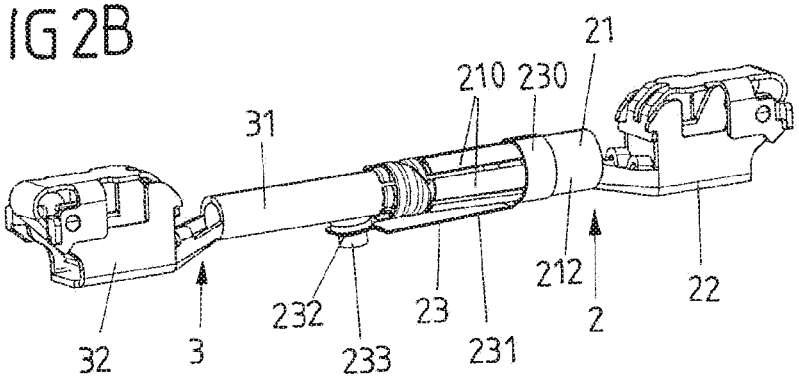
FIG. 2B shows the arrangement according to FIG. 2A after the contact element has come into electrical contact with the mating contact element.

FIGS. 1, 2A and 2B show an embodiment of a plug connector 1 which comprises a plug connector part 2 and an associated mating plug connector part 3, which can be engaged with one another in a plug-in manner in an insertion direction E for electrical contacting in order to establish a connection between electrical lines.

A plug connector 1 of this type may for example be used in a solar plant or a vehicle in order to interconnect lines that are intended to carry a load current. Here, the plug connector 1 is intended to be a plug connector having load switching capacity. The plug connector part 2 and the mating plug connector part 3 are thus intended to be interconnected under load and can also be disconnected from one another under load.

The plug connector part 2 comprises a contact element 21 in the form of a contact socket which is enclosed in a housing 20. The contact socket is formed by contact blades 210 that are arranged over the circumference of an insertion opening 211, extend in parallel with the insertion direction E, extend from a cylindrical shaft 212 and establish electrical contact with a mating contact element 31 in the form of a contact pin of the mating plug connector part 3.

Remotely from the contact blades 210, a contacting device 22 is connected to the cylindrical shaft 212, by means of which device an electrical line can be connected to the contact element 21 so as to be in electrical contact.

As mentioned, the mating plug connector part 3 comprises a mating contact element 31 in the form of a cylindrical contact pin 31 which can be inserted into the insertion opening 211 formed by the contact blades 210 in the insertion direction E in a plug-in manner in order to bring the plug connector part 2 into electrical contact with the mating plug connector part 3. A contacting device 32 is connected to the mating contact element 31, by means of which device an electrical line can be connected to the mating contact element 31 so as to be in electrical contact.

In order to connect the plug connector part 2 to the mating plug connector part 3 in a plug-in manner, a tip 310 of the mating contact element 31 is inserted into the insertion opening 211 of the contact element 21 and slid into the insertion opening 211, such that, as shown in FIG. 2B, the contact blades 210 electrically contact the mating contact element 31 and thus an electrical connection is established between the plug connector part 2 and the mating plug connector part 3.

Figure 3:
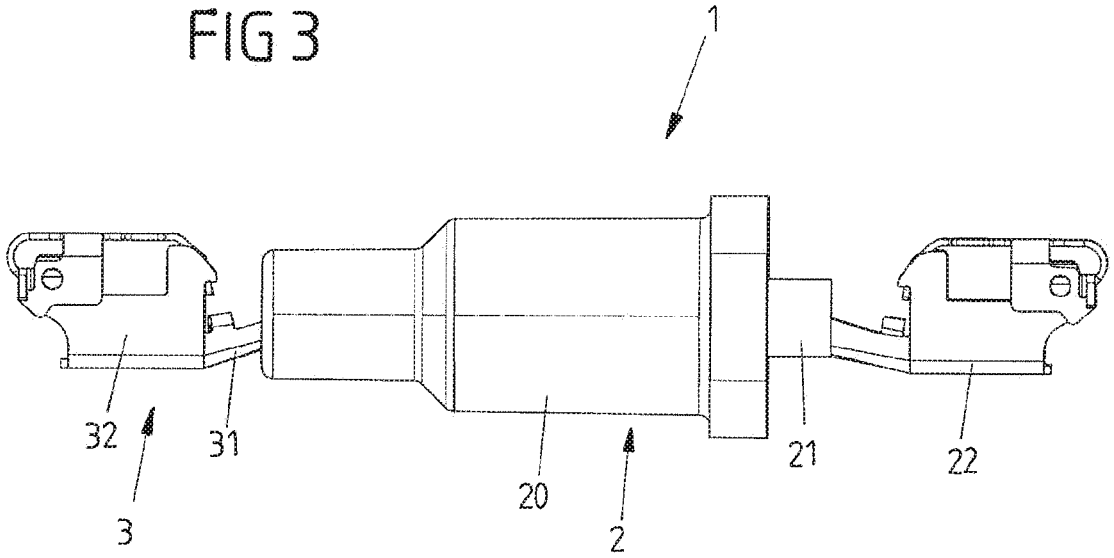
FIG. 3 is a side view of the plug connector.
Figure 4:
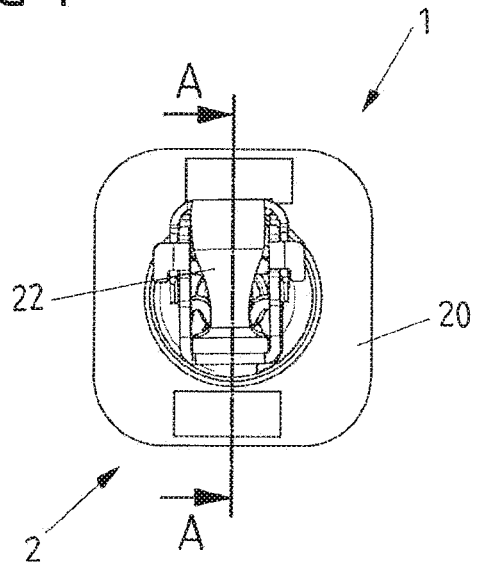
FIG. 4 is a rear view of the plug connector.

FIG. 3 is a side view of the plug connector 1 with the plug connector part 2 connected to the mating plug connector part 3, FIG. 4 is a rear view of the plug connector 1, and FIG. 5A to 5D show views with the plug connector part 2 and the mating plug connector part 3 disconnected from one another.

If the plug connector 1 is closed under load or is conversely opened under load, an arc may be produced between the plug connector part 2 and the mating plug connector part 3. In order to prevent damage to the contact blades 210 of the contact element 21 of the plug connector part 2 in this case, the plug connector part 2 comprises a lance element 23, which is arranged on the cylindrical shaft 212 of the contact element 21 by means of a connecting collar 230 and extends in parallel with the contact blades 210 outside the insertion opening 211 of the contact element 21 by means of an at least partially resiliently flexible shaft 231.

At an end remote from the connecting collar 230, in this case the shaft 231 has a contacting portion 233 on a head 232, which portion projects beyond the contact blades 210 in the insertion direction E and is for example made of an arc-resistant material.

The lance element 23 is made of an electrically conductive material, such that contact can be established between the mating contact element 31 of the mating plug connector part 3 and the contact element 21 of the plug connector part 2 by means of the contacting portion 233.

Figure 5A:
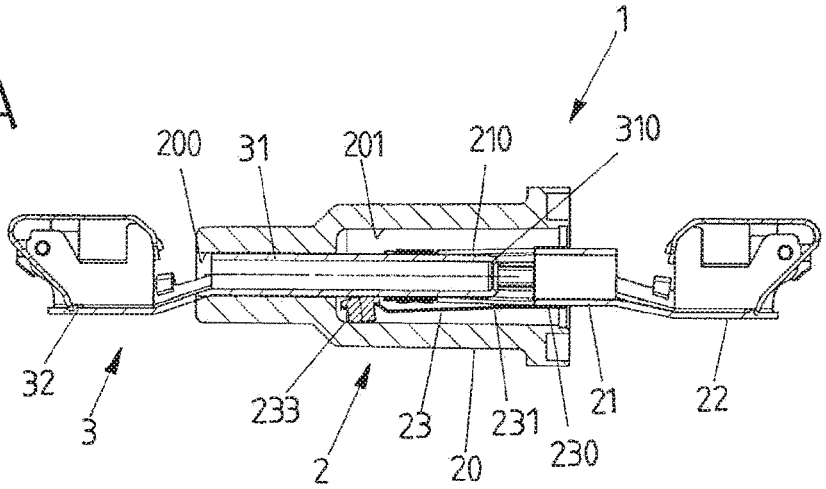
FIG. 5A is a sectional view of the plug connector along line A-A according to FIG. 4, with the contact element electrically contacting the mating contact element.

As shown in FIG. 5A, the contacting portion 233 is in electrical contact with the mating contact element 31 when the mating contact element 31 is inserted into the insertion opening 211. For the actual transmission of power via the plug connector 1, the lance element 23 is of secondary importance in this case. The lance element 23 is used in particular to divert an arc from the contact element 21, as shall be explained in the following.

Figure 5B:
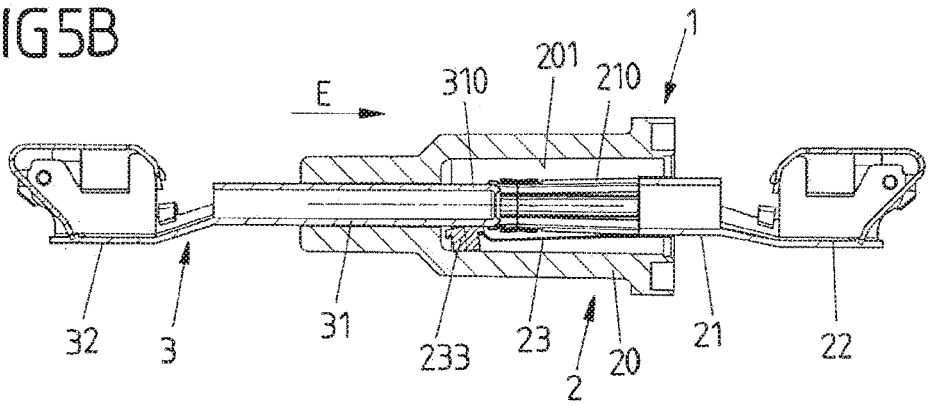
FIG. 5B is a sectional view according to FIG. 5A when disconnecting the contact element from the mating contact element.
Figure 5C:
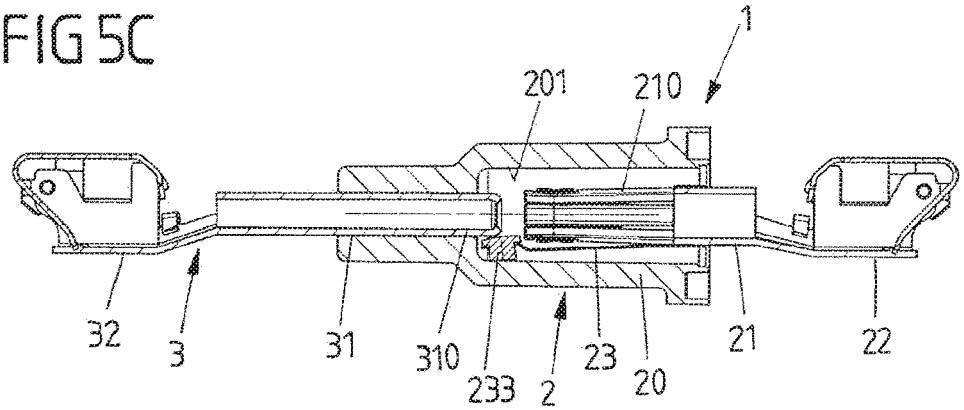
FIG. 5C shows the sectional view according to FIG. 5B when disconnecting the contact element from the mating contact element to a greater extent.

If the plug connector 1 is opened, the mating contact element 31 is pulled out of the insertion opening 211 in the contact element 21 counter to the insertion direction E, as shown in FIGS. 5B and 5C. In this case, the tip 310 of the mating contact element 31 initially comes out of the insertion opening 211, but the contact with the contacting portion 233 of the lance element 23 is initially maintained, as shown in FIGS. 5B and 5C.

Figure 5D:
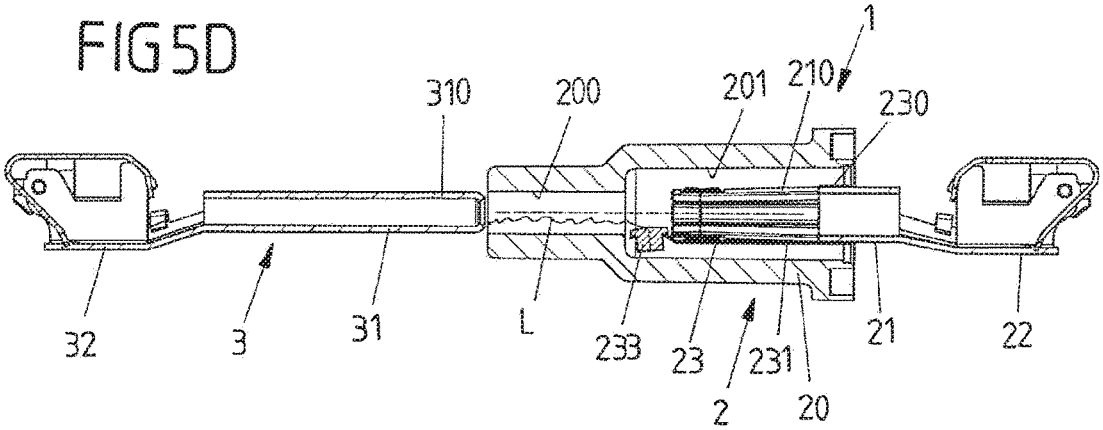
FIG. 5D shows the sectional view according to FIG. 5C when the contact element is disconnected from the mating contact element.

If the mating contact element 31 is pulled further out of the housing 20 of the plug connector part 1 counter to the insertion direction E, an arc L may be produced between the tip 310 of the mating contact element 31 and the closest electrically conductive portion of the plug connector part 2 located on the potential of the contact element 21, i.e. the contacting portion 233 of the lance element 23, as shown in FIG. 5D. The contact blades 210 are thus shielded from the arc L by means of the contacting portion 233 projecting beyond the contact blades 210, such that the arc L cannot cause any damage to the contact blades 210.

The contacting portion 233 is a sacrificial portion which can tolerate damage. The contacting portion 233 does not in fact have any importance for transmitting power between the plug connector part 2 and the mating plug connector part 3, but instead is used merely to divert the arc L when connecting or disconnecting the plug connector 1.

When the plug connector part 2 and the mating plug connector part 3 are plugged into one another, the contact between the plug connector part 2 and the mating plug connector part 3 is established in particular via a shaft portion of the mating contact element 31 remote from the tip 310 of the mating contact element 31, as shown in FIG. 5A. The tip 310 of the mating contact element 31 is therefore merely of secondary importance for the electrical contacting and for the power transmission between the plug connector part 2 and the mating plug connector part 3, such that (slight) damage to the tip 310 of the mating contact element 31 due to the development of an arc L can be tolerated.

It is also conceivable for the tip 310 of the mating contact element 31 to be made of an arc-resistant material. A tip 310 of this type could be designed as a sleeve placed onto the pin contact or as a partial surface coating. This results in a tip 310 in the form of a consumable ring, which has the same diameter as the contact pin itself, but is (significantly) more resistant to the effects of an arc than the contact pin itself.

Because an arc L is thus produced between the contacting portion 233 of the lance element 23 and a non-critical region of the mating contact element 31, namely the tip 310 of the mating contact element 31, damage due to the arc L in the regions that are operationally essential to bringing the plug connector part 2 and the mating plug connector part 3 into electrical contact can be effectively prevented.

Connecting the plug connector part 2 to the mating plug connector part 3 results in a reverse sequence, in which, proceeding from the position according to FIG. 5D, the mating contact element 31 is plugged into the insertion opening 211 of the contact element 21 in the insertion direction E, with an arc L potentially being produced between the tip 310 of the mating contact element 31 and the contacting portion 233 of the lance element 23, but not extending as far as the contact element 21. The contact element 21 is thus also effectively shielded from an arc L when connecting the plug connector 1.

During insertion, the tip 310 of the mating contact element 31 initially runs onto the contacting portion 233 of the lance element 23 (FIG. 5C), as a result of which the shaft 231 is resiliently urged outwards to the side and the contacting portion 233 thus rests against the mating contact element 31 under resilient pretension. As it is inserted further, the mating contact element 31 ultimately reaches the region of the insertion opening 211 and comes into contact with the contact blades 210, as shown in FIGS. 5B and 5A.

The housing 20 forms a space 201 in which the contact element 21 is received. The mating contact element 31 can be inserted into the housing 20 through an insertion opening 200 and can be brought into contact with the contact element 21 inside the space 201 in the housing 20.

The housing 20 is preferably made of an electrically insulating material, preferably of a material having high dielectric strength.

Figure 6:
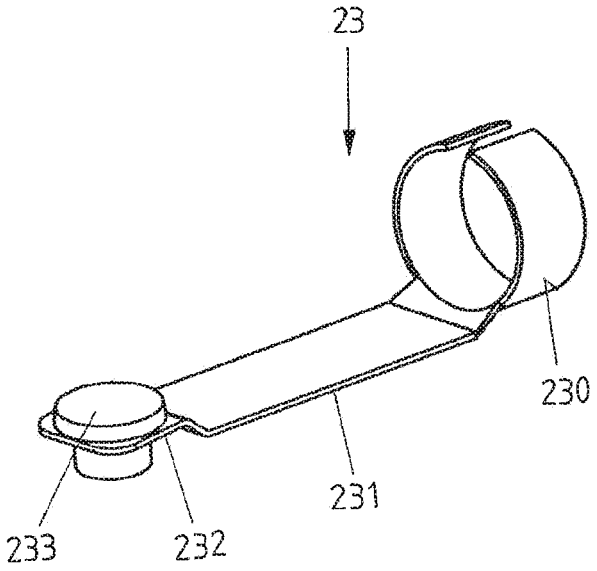
FIG. 6 is a separate view of a lance element arranged on the contact element of the plug connector part.

In the embodiment shown in FIG. 1 to FIG. 5A-5B, the lance element 23 together with a contacting portion 233 is manufactured in the form of a rivet placed onto the head 232 of the shaft 231. FIG. 6 is a separate view of said embodiment of the lance element 23. The shaft 231 is manufactured in one piece from an electrically conductive material together with the head 232 and the connecting collar 230. The contacting portion 233 is also electrically conductive and is preferably made of an arc-resistant material or coated with an arc-resistant material in this case.

Figure 7:
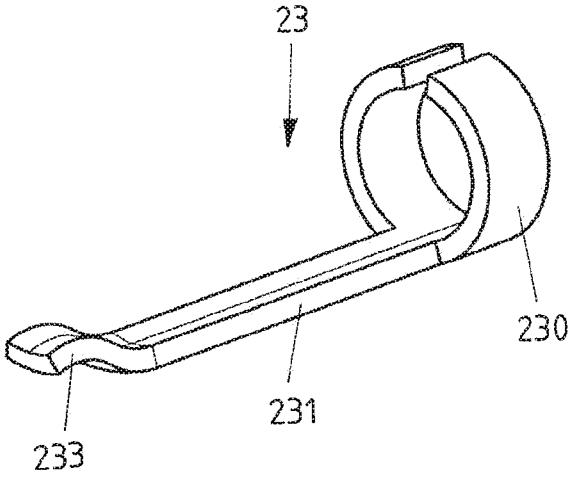
FIG. 7 is a view of another embodiment of a lance element.

FIG. 7 shows another embodiment of a lance element 23 in which the lance element 23 is formed in one piece as a whole. Here, the contacting portion 233 is formed in one piece on the shaft 231 by the shaft 231 being reshaped in a curved manner at the end thereof remote from the connecting collar 230.

In this embodiment, the lance element 23 as a whole may be made of an arc-resistant material or coated with an arc-resistant material (at least in portions).

The concept underlying the invention is not restricted to the embodiments set out above, but can in principle also be implemented in an entirely different manner.

A lance element of the type described here can be used in a cylindrical contact element or also in a flat contact. Here, a plug connector may comprise one or more contact elements.

A lance element of the type described here can also be arranged on a contact element in the form of a contact socket or in the form of a contact pin. It is also conceivable to use said lance element on a hermaphroditic electrical contact.

A contacting portion may be in the form of a rivet; however, other shapes are also conceivable and possible.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 Plug connector
2 Plug connector part
20 Housing
200 Insertion opening
201 Space
200 Contact element
210 Contact blades
211 Insertion opening
212 Cylindrical shaft
22 Contacting device
23 Lance element
230 Connecting collar
231 Shaft
232 Head
233 Contacting portion
3 Mating plug connector part
31 Mating contact element
310 Tip
32 Contacting device
E Insertion direction
L Arc

The invention claimed is:

1. A plug connector part for electrically contacting a mating plug connector part, comprising:

a contact element, which is engageable in a plug-in manner with a mating contact element of the mating plug connector part in an insertion direction for electrical contacting; and a lance element that comprises an at least partially resilient shaft and a contacting portion, the shaft being connected to the contact element at a first end of the shaft and the contacting portion being arranged at a second end of the shaft such that the contacting portion remains in electrical contact with the mating contact element of the mating plug connector part when the plug connector part is released from the mating plug connector part after the electrical contact between the contact element and the mating contact element has already been broken, wherein the shaft is connected to the contact element at the first end of the shaft by a connecting collar, and wherein the contacting portion of the lance element comprises a separate contacting element arranged on the shaft, the separate contacting element comprising an arc-resistant material at least in part.

2. The plug connector part according to claim 1, wherein the contacting portion is configured to come into electrical contact with the mating contact element of the mating plug connector part before the contact element when the plug connector part is plugged into the mating plug connector part.

3. The plug connector part according to claim 1, wherein the lance element projects, by the contacting portion thereof, beyond an end of the contact element to be plugged into the mating contact element, when viewed in the insertion direction.

4. The plug connector part according to claim 1, wherein the shaft extends on the contact element in parallel with the insertion direction.

5. The plug connector part according to claim 1, wherein the shaft of the lance element, when viewed radially with respect to the insertion direction, extends outside the contact element.

6. The plug connector part according to claim 1, wherein the contact element comprises a plurality of contact blades, which form an insertion opening therebetween into which the mating contact element of the mating plug connector part is insertable.

7. The plug connector part according to claim 1, wherein the plug connector part comprises a housing which forms a space in which the contact element is arranged.

8. A plug connector, comprising:

the plug connector part according to claim 1; and the mating plug connector part that is engageable with the plug connector part in a plug-in manner.

9. The plug connector part according to claim 1, wherein the arc-resistant material comprises Ag/Ni, W/Cu, Ag/SnO2, or Ag/Cu.

10. A method for bringing a plug connector part into electrical contact with a mating plug connector part, comprising:

engaging a contact element of the plug connector part in a plug-in manner with a mating contact element of the mating plug connector part in an insertion direction for electrical contacting, wherein, in a plug-in connection, a contacting portion of a lance element that comprises an at least partially resilient shaft that is connected to the contact element at a first end and supports the contacting portion at a second end, comes into electrical contact with the mating contact element of the mating plug connector part before the contact element, wherein the shaft is connected to the contact element at its first end by a connecting collar, and wherein the contacting portion of the lance element comprises a separate contacting element arranged on the shaft, the separate contacting element comprising an arc-resistant material at least in part.

* * * * *